United States Patent [19]

Zappia

[11] Patent Number: 4,854,378

[45] Date of Patent: Aug. 8, 1989

[54] HEAT TRANSFER AND FLUID HEATING DEVICE

[76] Inventor: Joseph M. Zappia, 235 N. W. 26th Ave., Miami, Fla. 33125

[21] Appl. No.: 923,295

[22] Filed: Oct. 27, 1986

[51] Int. Cl.[4] ..... F28D 15/00

[52] U.S. Cl. ..... 165/104.19; 165/104.28; 122/366

[58] Field of Search ..... 165/104.26, 104.21, 165/104.19, 104.28; 122/366

[56] References Cited

U.S. PATENT DOCUMENTS

| | | | |
|---|---|---|---|
| 2,893,706 | 7/1959 | Smith | 165/104.19 |
| 3,229,759 | 1/1966 | Grover | 165/104.26 |
| 4,258,780 | 3/1981 | Suo | 165/104.21 |

*Primary Examiner*—Albert W. Davis, Jr.
*Attorney, Agent, or Firm*—Victor F. Volk

[57] ABSTRACT

An enclosed chamber filled with any fluid such as water, is formed by connecting a metal heater cap or plate to one end thereof and the entire inner chamber is lined with a thin fibrous and absorbent material. The lining of the cap or plate is the blanket and the lining of the inner chamber walls is the wick; a rope type wick may also be used. The heater cap or plate with its blanket is placed adjacent to a heat source, whereas the molecules of colder water are separated and held in suspension in said blanket, thus said molecules are heated at a very rapid rate in a superimposed manner and are ejected into the chamber with force. The layers of hotter molecules will quickly build up from the blanket, thus forcing the colder molecules thereabove to move effficiently by taking the path of least resistance, which is the wick, to return to the blanket in a superimposed manner for reheating, thus the heating cycle is completed quickly with great efficiency. If the other adjacent end of said chamber is enclosed then said hotter water is held for storage and future use; however if an unlined emitter cap is used to enclose said chamber then said emitter cap will quickly transfer heat from the water therein to its environment to do work such as, heat a room, or to disperse the heat to its environment, thus reducing unwanted heat at the heat source and its environment in a most efficient manner. Gravity has no affect on the molecular movement in this device; therefore it may be used in any position desired without any loss of efficiency.

5 Claims, 1 Drawing Sheet

HEAT TRANSFER AND FLUID HEATING DEVICE

The invention is a great energy conservation device which does not contain any moving parts and when used to transfer unwanted heat from a heat source, thus reducing heat accumulation at such source and the adjacent environment, then the invention is not related to any other device on the market today.

When said invention is used to transfer heat to do work it is related to an application such as a hot air heating system used in the homes or a hot water circulating system used to heat the interior of an automobile.

When said invention is used for the heating and storage of fluids then it is related to an application such as a hot water heating and storage system, both conventional and solar, used in homes and industry.

BACKGROUND OF THE INVENTION

At the present time there is a great need to remove the tremendous amount of unwanted heat that accumulates around work producing devices such as, electric motors, generators, transformers and massive electronic components as well as around combustible engines and other heat producing devices. Said heat producing devices are generally housed in an enclosure like a cabinet with vents therein, thus creating a confined area for heat accumulation at and adjacent to said devices. Since work devices convert a great deal of wasted energy into heat then a means must be available to remove such unwanted heat immediately because as the temperature therein remains high or continues to increase then the efficiency of said devices will be decreased proportionally, thus greatly increasing the cost of operation due to the loss of energy as heat, as a fact heat accumulation will also reduce the life of said device causing early failure.

The only method presently used for heat removal is to mount high speed fans in the enclosure adjacent to such heat source and direct said fans to force air over said heat source towards the vents or openings in said enclosure or cabinet. Unfortunately said vents are generally located in the lower part of the back panel, and the fact that hot air will rise, such heat will be entrapped in the upper chamber of said cabinet therein; futhermore the present system tries to disperse such heat into the adjacent area which is quickly heated to the same temperature, thereby causing an added heat build up adjacent thereto. Also the high speed fans are very noisy and ineffectively blow some of the heat through the vents, whereas the balance of the heat is also entrapped therein thus creating a very inefficient system.

Presently heat is transferred from a heat source to another area to do work such as the heating of rooms or offices to a certain temperature. This transfer of heat is accomplished by heating air in a large centralized furnace then using expensive and inefficient duct works with blowers to force such heated air through said ducts to designated areas. Since there is a great heat loss and a drastic reduction in the velocity in moving such heated air, which is due to the effects of friction per foot traveled in said ducts, thus requiring such air to be heated to a high temperature at the furnace then use powerful high speed blowers to move such heated air just to compensate for the negative effects of friction. It is common knowledge that rooms more distant from the heat source experience a very weak output of heat therein; therefore the final air temperature in each of the rooms will vary drastically and this is further magnified when the heating control thermostat is only located and operated from just one of said rooms.

In hot water heating systems pumps are used to circulate the hot water through heating cores for area heating. This system is expensive to install, operate and to maintain as well as having a very slow start up heating time rate. As an example the circulating hot water heating system in automobiles is very slow to initially heat the inside of the passenger compartment to a comfortable temperature, especially when the outside temperature is at or below zero degree centrigrade. Furthermore the high speed water pump in said system puts a heavy load on the engine, thus increasing fuel consumption and said water pump generally has a short life and is expensive to replace.

The present state-of-the-art relating to the heating and storage of any type of fluid in an enclosed chamber, whereby the molecules of said fluid must move according to the theory of displacement and the law of gravity, thus making said system very slow, inefficient and expensive to operate.

As an example in a conventional hot water heating system the tank is filled with millions of molecules of water at the same temperature, thereby said molecules are in an inert state. To activate the process a heating element is placed below said tank to heat the heavy mass of molecules therein that are in heavy contact with each other, thus only a very small amount of the bottom surface of each molecule is exposed to the heat at the inner surface of the base adjacent to and above said heat source. As each molecule of water is slowly heated it is energized and will try to move upward from said hot base plate against the heavy mass of colder molecules above thereof. At the same instant that a hot molecule leaves said base another molecule must move in to fill such place since there can be no void therein, this is the theory of displacement. Any other hot and energized molecule will resist this exchange; therefore only a colder and less active molecule will be compatible and offer little resistance to such an exchange.

Furthermore a colder molecule of water is heavier than a hotter molecule of water; therefore the downward pull of gravity is greater on a colder molecule, thus each colder molecule will try to move downward by going in between and below the high mass of hotter molecules tightly pressed together thereunder. The entire mass of colder molecules of water are being pulled in a downward direction by the force of gravity, thereby acting like a hugh ram over the entire mass of hotter and lighter molecules thereunder as such as produced at the base above the heat source. Therefore the line adjacent to and above the base where the hotter and colder molecules are in direct contact presents the area where there is a very strong resistive force of position exchange created by the mass density of same. It is apparent that the upward movement of just one hotter molecule of water by gravitational separation would be a very slow and most erratic path since said molecule will encounter thousands of head on collisions with the tightly pressed together mass of heavier colder molecules thereabove as said hotter molecule is forced to the top of the tank by the continual process of displacement, which makes the present system very slow and inefficient, thus the heating and storage of water is presently one of the highest cost items in the household. To conpensate for the very slow heating cycle of the present system the capacity of said tank must be large in order to handle the initial surge of hot water withdrawal and to hold a reserve therein since the volume of hot water created, during constant withdrawal can not equal the output demand, thus the condition of hot water depletion is frequently encountered. The fact that hot water withdrawal is made fron the top of the tank at all times, whereas hot water is always created at the bottom of said tank clearly indicates that said hot water molecules must still travel the erratic collision prone path to the top thereof in a slow and inefficient route. Furthermore this very slow heating cycle requires that the heat source be turned up to a very high energy level to expedite said heating; therefore a safety blow-off valve must be affixed to the top thereof since a thermostat failure will allow the water to reach the boiling point, thus creating steam and a most dangerous condition.

The foregoing explaination of the present molecular flow of fluids in an enclosed chamber whether for heat transfer or for the storage and use of same has been reason that an effective heat transfer device has not been developed and the present hot water heating and storage systems are expensive to install, operate and maintain.

To overcome the shortcomings of the existing methods of removing unwanted heat accummulation at the heat source, the present invention is a long narrow enclosed chamber, filled with a fluid such as water, formed by a long tubular section with a heater cap and an emitter cap connected to the adjacent ends thereof. Said caps are made of an inexpensive material that has a high coefficient of heat conductivity, whereby the inner surface of said heater cap is lined with a thin fibrous and absorbent blanket that will separate and hold droplets or molecules of water in suspension for very rapid heating of said molecules of water. To said blanket is attached one adjacent end of a rope like wick, made of the same material as said blanket, and said wick will extend throughout said tube member and the other adjacent end thereo is fastened to the inner part of the emitter cap. The heater cap is placed near or attached to the heat producing device and the long tube member is extended to a cooler remote area to disperse such heat transferred thereto from the heater cap through the blanket, which heats the water at a very rapid rate, then quickly moves such heat through said tube member to the emitter cap in the cooler remote area to disperse such heat therein. The heat transfer rate is so fast that a drastic reduction of temperature will prevail at the heat producing device, in the enclosure or cabinet as well as the adjacent environment thereto. The embodiment of the invention that deal with the molecular flow of fluids therein is explained in detail when the advantages of the hot water heating and storage system is explained, which applies to this device as well.

To overcome the shortcomings of the existing method of using a large furnace to heat air at a central location, to a high temperature, then use high speed blowers to force such heated air through large air ducts into other rooms; the invention previously described will completely eliminate all large and expensive duct works, the high speed blowers and the large furnace with the large air chamber therearound. A plurality of the said heat transfer devices may be used or more advantageously use only one large heater cap with a plurality of branching tube members therefrom, whereby one or more of said tube branch members may be extended and located in each room with an emitter cap on the end thereof; thereby only one small central heating source is needed to heat the heater cap to just a few degrees above the maximum desired temperature. The one large heater cap is very small when compared to the present furnace but is a large or larger cap when compared to the standard small heater caps; therefore the heat source will be small and the energy output will be low as well. The heat from the heat source will be transferred automatically from said source quietly and quickly through the central heater cap, then through the blanket and through the entire length of each tube member, to the emitter caps on the adjacent end thereof to disperse such heat into said room for heating purposes. Moreover the emitter cap may be made of any shape and length, even with cooling fins thereon and a small slow speed fan placed adjacent to and behind said cooling fins to gently circulate such heated air around said room. In addition said emitter cap and fan could be in a recess behind a wall grille, whereas a thermostat could be placed in said room to control the fan and shutter if needed, thereby each room would be heated to and retained at the temperature desired thus completely eliminating the high temperature differential that presently exists in different rooms as produced by the present system.

To overcome the shortcomings of the present slow and inefficient heating systems that use circulating hot water such as in automobiles, the heat transfer device is easy to install, has no pump and has a very fast start up heating cycle. The heater cap, of the invention, would be attached to the automobile's manifold and the tube member would be extended and connected to the automobile's heater core, thereby the emitter end of said invention would now be the existing heater core with its fan that is presently mounted behind and under the dashboard in all automobiles; furthermore said device would be filled with anti-freeze for the winter weather. Since the automobile's manifold is heated to a very high temperature immediately after the engine is started, thus such heat is transferred at a very rapid rate through the heat transfer device into the heater core of the automobile, whereby when the heater is turned on in said automobile and the baffle is opened and the fan is turned on then such heat will be dispersed into the passenger compartment and in a few seconds said compartment would be heated to a comfortable temperature even when the outside temperature is below zero degrees centigrade.

To overcome the shortcomings of the existing methods of heating and storage of water the invention only utilizes the theory of displacement in regard to molecular movement therein, whereas the separation of hot and cold molecules in said chamber by the force of gravity does not apply; therefore the confrontation of hot and cold molecules of water moving in an opposing direction, in the same chamber, causing an erratic and collision prone path for all molecules is completely eliminated. Therefore the heating cycle time of the invention is very short resulting in reducing the size of the present hot water storage tank to only a fraction thereof and also greatly reducing the cost of heating water to a small fraction of the present costs, which is usually the highest cost item in the household.

This is accomplished by the main embodiment of the invention that also applies to all the applications and other devises herein mentioned or explained, whereby the molecular flow of fluids within is in an orderly manner and all molecules will freely flow along the path of least resistance.

The principal object of the invention is to have a thin blanket inner lining in the heater cap or covering the inner surface of the heater plate in the water tank, whereas molecules of colder water are separated and suspended in said blanket. When heat is applied to said heater cap or heater plate then the molecules of water in said blanket will be heated at a very rapid rate because each molecule of water in said blanket will expose a much greater surface area to pick up such heat since they are separated and in suspension therein. When the heated molecule of water is strongly ejected from said blanket it is replaced by a colder less active molecule of water that has traveled from the emitter cap or top of the tank by coming down and through the wick, which is the path of least resistance, then into the blanket. Therefore there is an orderly flow of molecules throughout the heating cycle in a fast and efficient manner the path all molecules will travel is a path of very low resistance and the present erratic collision prone path has been completely eliminated. Since gravity does not affect this system then the layers of hot water molecules will stay at the bottom adjacent to the heat source and build up in said layers while the colder molecules will be in the upper portion of said chamber, thus there are no position exchange of hot and cold molecules in the mainstream but only in the blanket. When there is hot water withdrawal from said tank the outlet for said hot water would be at the bottom of said tank, just above and adjacent to said blanket in the immediate area where hot water is created, thereby under continual withdrawal of hot water the depletion of hot water is eliminated since said molecules of hot water do not have to travel to the top of said tank to the outlet as required in the present system. As a fact the invention only requires that the heat energy source be set at a low level as desired by setting the temperature of the thermostat, which is located at the base above the blanket, whereby even during continual operation with a faulty thermostat the water temperature could not reach or be near the boiling point of water. This is possible because the heating of said water is so fast and the heat loss is so low that the desired water temperature is produced and retained immediately, thereby the heating cycle will exceed the withdrawal rate immediately after the initial withdrawal surge. In fact another variation of the embodiment of the invention will permit in-line direct heating of water, whereby the heating source is turned on when water is passed through said device and a continuous supply of hot water is produced for output.

Since said invention is very simple and has no moving parts or pumps it is apparent that the manufacture of same would be very inexpensive and easy to install and maintain, in fact the invention will operate trouble free for many years.

SUMMARY OF THE INVENTION

When the invention is used as a unidirectional heat transfer device an enclosed long narrow chamber is formed that is filled with any fluid, such as liquid or gas; however in this example water is used. The main body of the invention would be a long rigid or flexible tube, whereby on each adjacent end thereof, caps made of a high heat conductive material are connected thereto so that no fluid therein may leak out. One cap is the heater cap and a thin film lining made of any fibrous and highly absorbent material will be applied to the inner surfaces of said heater cap like a blanket. To said blanket is attached a rope like wick or the blanket lining could be continued to cover the inner walls of said tube, whereas either wick is made of the same material as the blanket and either wick will extend the full length through said tube and the other adjacent end thereof will terminate at or be fastened to the emitter cap on the adjacent end of said tube.

Another object of the invention is to have said invention automatically function whenever the temperature of the heater cap is greater than the temperature of the emitter cap. The said invention is so sensitive that it will begin and continue to transfer heat from the heater cap to the emitter cap whenever the temperature differential between said caps is just a few degrees and even if such temperatures are high or below zero degree centigrade. Said device's operation will be stabilized and automatically cease to operate whenever the temperature differential between said caps is less than one degree centigrade.

A further object of the invention is to make said device very sensitive to heat and begin to operate immediately by having the colder molecules of fluid separated and suspended in the blanket inner lining of the heater cap, whereby each molecule in said blanket will expose the largest amount of its surface to the heat conducted thereto, thus said molecules therein will be quickly and efficiently heated and ejected from said blanket into the mainstream.

Another object of the invention is to provide a wick as a separate and exclusive path for colder molecules to travel in said chamber from the emitter cap, where hotter molecules give off their heat and become a colder molecule, back to the blanket to be reheated, since said wick is the path of least resistance then the colder molecules therein will move at a rapid pace in an orderly manner. When a colder molecule is heated, in said blanket, it is ejected with force into the main chamber adjacent to and above said blanket, thereby a colder molecule in said wick will simultaneously move into said blanket to fill such space due to the theory of displacement. Furthermore the force, created by the mass of hotter molecules being forcefully ejected from said blanket will push the colder molecules ahead of same and said colder molecules will take the path of least resistance which is the wick in the invention. Thus, in the invention, both hotter lighter molecules and the colder heavier molecules are not affected by the gravitational law of separation, which requires said molecules to only move by position exchange in the chamber's mainstream; hence gravity has no affect in the said chamber as all hotter and colder molecules move up through the chamber, down through the wick then into the blanket to be reheated, whereas said molecular movement in the heating cycle takes place in a very fast and orderly manner.

A further object of the invention is that the heater cap must be made of a high heat conductive material and may be of any shape or length and even have heat fins thereon for greater sensitivity to heat pick up. Said heater cap is suspended, submerged or is placed in contact with the heat source and the tube thereof is extended to some remote area for the positioning of the emitter cap, on the adjacent end thereof. The emitter cap, made like said heater cap, may be suspended, submerged or placed in contact with the colder receiver of such heat to do work or to be dispersed therein. Furthermore the location of the emitter cap may be in any direction from the heater cap as viewed in a 360 degree spherical area. In fact the emitter cap could be positioned 90 degrees above the heater cap and the mass of hotter molecules ejected from the blanket would form at the bottom adjacent to and above said blanket and move upward in layers to the emitter cap while pushing the colder molecules ahead thereof at a very rapid rate because gravity does not affect this system.

An additional object of the invention is to make said invention bidirectional for use in temperature control applications. This can be simply done by lining only a portion of the inner surfaces of the heater cap, the tube and the emitter cap with one continuous film of a fibrous and absorbent material, thereby making the lining in the tube the wick and each cap will be both a heater cap and an emitter cap, whereas the portion of said cap with the lining automatically becomes a heater cap. It is apparent that the cap exposed to the hotter temperature will automatically become a heater cap and will use its blanket to transfer heat to the other cap on the end thereof of said tube, said cap would automatically become an emitter cap and disperse such heat through the unlined portion of said cap. If one end of said device is placed in an environment with a constant controlled temperature, such as an underground stream, then the other end of said device is located in an enclosed environment will either give off heat to heat said colder environment or said cap will pull out the excess heat from said environment to cool same, thus the temperature will stabilize when the temperature of the said environment is less than one degree of the temperature of the controlled source.

Another object of the invention is to utilize a plurality of heater caps and or a plurality of emitter caps as required by the application. In such a configuration there must be one common wick network generally originating in the one central cap and said wick is fragmentized from said cap, whereas a small rope like portion of same will extend through each member branch thereof to the caps on the other adjacent end thereof. As an example, in a solar hot water heating system a plurality of long or large heater caps are exposed to the sun and the tubes or branching members thereof would extend to a large hot water storage tank, whereby said members would join together and merge into one large flat emitter cap which will perform the function of a heater plate under said tank to heat the water as will be described. In a central heating system for the home then one central heating cap would transfer heat to a plurality of emitter caps, whereby at least one branching member thereof would be located in each room to heat said room under individual thermostat control per room; however one common wick network must be provided as was previously explained.

A final object of the invention is to heat and store hot water by using a storage tank and installing a blanket on the inner base thereof directly above the heat source thereunder and have a wick or wicks attached to said blanket and extend said wick or wicks to the top of said tank and fasten the ends thereto, thus the molecules of water will flow in a fast orderly manner completing the heating cycle previously described. Said blanket will strongly eject heated molecules of water into the main chamber, thereby forcing the colder molecules to move through the wick back to the blanket to be reheated, thus all molecules will travel the path of least resistance in a cyclic manner, without confrontation of making position exchanges in the mainstream, thus resulting in a very fast heating cycle in the invention. This is possible because the gravitational separation of hot lighter molecules from colder heavier molecules does not exist in the invention.

The main embodiment of the invention is the use of the blanket and the wick in an enclosed chamber, hence the four broad applications presented are still the same device with only the design of the enclosed chamber being different, whereby said chamber design is most effective for use in said category of applications. The present invention is a great energy coservation device that is very simple in structure and will be very easy to manufacture, install and operate; furthermore since it has no moving parts and operates automatically said invention will have a long life of maintenance free operation. Since said invention has such wide spread usage it is apparent that no related type of device has ever been made before.

BRIEF DESCRIPTION OF THE DRAWINGS

Other objects and advantages of the invention will become more apparent from the specifications taken in conjunction with the accompanying drawings, in which.

DETAILED DESCRIPTION OF THE INVENTION

Figure 1:
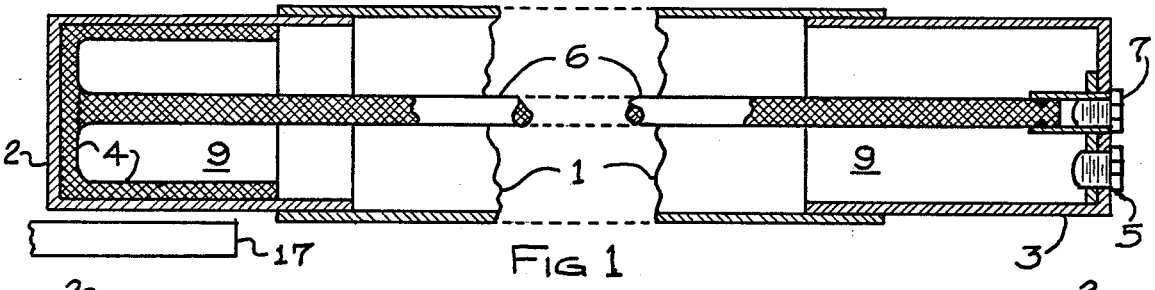
FIG. 1 is a cross sectional view of a heat transfer device with a blanket in the heater cap and one form of wick being a rope type member.

FIG. 1 is the embodiment of the invention that is used to transfer heat from a heat source to a remote area to do work or to be dispersed into said area, thus greatly reducing heat accumulation at the heat source and its adjacent environment.

Referring to the drawing in FIG. 1, numerial 1 designates the main body of the device, a long narrow container such as a tube 1, which may be of any shape or length and it should be made of a leak proof, non heat conductive material which may be rigid, flexible or a combination of the two. To each adjacent end of tube 1 a heater cap 2 and an emitter cap 3, made of an inexpensive high heat conductive material, are attached thereto making a leak proof connection. The heater cap 2 may be of any shape or length, preferably to conform to the shape or area of the heat source, whereby heater cap 2 is in contact or adequately exposed to said heat course for greater heat pick up by said heater cap 2. Said heater cap 2 is inner lined with a layer of fine mesh or a fibrous material that has a high absorption rate to form a thin blanket 4 therein; furthermore since said heater cap 2 is of a high heat conductive material then it is apparent that heat applied to any point on the surface of said heater cap 2, such heat will immediately be distributed throughout heater cap 2 and the blanket therein, thus making said device very sensitive to heat pick up when generally the outer side walls of heater cap 2 will be in direct contact with the heat source or said cap 2 will have heat fins thereon when suspended in said environment. A long cord like wick 6, made of the same material as that of blanket 4, has one adjacent end thereof fastened to any part of said blanket 4. In FIG. 1 said wick 6 is fastened to the top center of blanket 4 in center cap 2 for better distribution of colder molecules to blanket 4. Said wick 6 is extended the full length of tube 1 and into emitter cap 3, whereas the adjacent end thereof is fastened to sleeve plug 7 in the top inner center of emitter cap 3. The entire inner chamber 9 is filled with any type of fluid, such as water or anti-freeze, by pouring same through filler plug 5 while sleeve plug 7 is loosened for the venting of any entrapped air therein. After filling same the filler plug 5 and the sleeve plug 7 are tightened into place making the entire heat transfer device leak proof and free of any air pockets and is ready for use.

The invention of a heat transfer device is activated and begins to operate whenever the temperature differential at heater cap 2 is greater than the temperature at emitter cap 3. The invention will work very fast and efficient even when such temperature differential is just a few degrees and also operates at very low and high temperatures. Said heat transfer device will cease to operate whenever the temperature differential between heater cap 2 and emitter cap 3 is less than one degree centigrade.

A basic application is to remove the unwanted heat from a heat source such as, electric motors, transformers, generators, massive electronic circuitry and even combustible engines, whereby said work producing devices are mounted in a small enclosure generally with inadequate vents therein. The device in FIG. 1 is used to transfer unwanted heat from the heat source to a remote area, whereby such heat may be dispersed into said cooler environment of the remote area, thereby greatly reducing the heat accumulation at the heat source and the adjacent environment thereto. The heater cap 2 of said invention is suspended, immersed or attached to or near the heat source, generally inside the enclosure housing such work producing devices. The long tube 1 is extended to a remote colder area, whereas emitter cap 3 on the end thereof is suspended or immersed in said colder environment, such as outside or in an underground cavity or stream, and such heat transferred thereto will be dispersed therein.

The molecules of water completely occupy all the space in chamber 9 including the complete wick 6 and the blanket 4; therefore the theory of molecular displacement applies, whereas when one molecule moves from its position a void can not exist therein, thus there is a simultaneous position exchange among many molecules in chamber 9 until such condition is stabilized.

Figure 2:
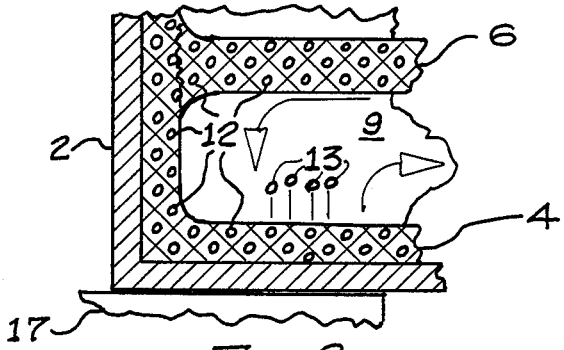
FIG. 2 is an enlarged view of a cross sectional fragment of the blanket and a wick indicating how molecules are separated, held in suspension and move therein.

FIG. 2 is an enlargement of a segment of heater cap 2, blanket 4 and wick 6 to show how molecules of colder water 12 are separated and held in suspension amoung the fibers of the pourous and absorbent material that they are made thereof. The heat source 17 will heat the heater cap 2 and conduct such heat through blanket 4, whereby said molecules of colder water 12 are suspended in blanket 4 and expose almost all of its surface to said heat, thus said molecule 12 will be easily and quickly heated and become a hotter molecule 13 which is immediately ejected from blanket 4, with force at a high rate, into the mainstream of chamber 9 adjacent to and outside of blanket 4. Simultaneously a less active colder molecule 12 that has traveled from emitter cap 3, down the wick 6 to a position adjacent to blanket 4, will easily and quickly move from wick 6 into blanket 4 to fill the space previously occupied by the currently ejected hotter molecule of water 13, thus there is an orderly flow of molecules at a very rapid rate making said device very sensitive to heat differential and efficiently transfer same. In FIG. 1 the foregoing process of heating molecules of water, as described for FIG. 2, whereby said hotter molecules 13 are strongly ejected from said blanket 4 into chamber 9 which will cause said hotter molecules 13 to build up in layers adjacent to and to the right of blanket 4 in heater cap 2 of FIG. 1, until such vertical layers reach the emitter cap 3 to disperse their heat thereto, said process only takes a few seconds even with a long tube 1.

Since emitter cap 3, in FIG. 1, is in or attached to an environment that has a lower temperature than that of the heated molecules therein emitter cap 3, then such heat differential is transferred by conductivity to and through emitter cap 3, which in turn will disperse such heat by conduction or radiation to its environment. As the hotter molecules transfer their heat in said manner they become a less active colder molecule and as such will seak the path of least resistance back to blanket 4, in this case such path is the wick 6, said process is due to the theory of displacement. Whereas hotter molecules will not try to go in or stay in wick 6 because said molecules are more active than the colder molecules; therefore wick 6 becomes an exclusive easy and quick path for only colder molecules to travel. It is apparent that the unwanted heat at the heat source will be transferred through heater cap 2, blanket 4, tube 1 and emitter cap 3 then into the colder environment of the remote area, thus greatly reducing the heat accumulation at the heat source immediately as well as the adjacent environment therearound to a temperature that will eliminate the need for air conditioners or greatly reduce the size of same.

When the invention in FIG. 1 is used to transfer heat to do work said device will transfer heat as previously described; however the emitter cap 3 will be designed and located as and where necessary according to the requirements of the application.

As an example in using the invention to replace the central hot air heating system in the home the embodiment of the invention will apply; however the object of using a plurality of heater caps 2 and or emitter caps 3 will be used. In this applicatin a single large heater cap 2 will be used with a plurality of branching members of tubes 1 originating therefrom and each of the branching members will be extended to a wall grille in each of the rooms. Using FIG. 1 as a reference for a single tube 1 member, a plurality of said members may be connected to heater cap 2 in any array as long as one important element is adhered to, which is that the larger wick 6 attached to the blanket 4 in heater cap 2 must be fragmentized so that a segment thereof is extended throughout each branching member 1 and into the emitter caps 3 on the adjacent end of each member, thus forming one common wick network for automatic operation. The transfer of heat from the heat source to the emitter caps 3 is as previously described; however the flow of hotter molecules through said branching members is automatic, whereby the emitter cap 3 on a branch member that is in the coldest environment will feed the greatest number of colder molecules through segment of wick 6 therein to the blanket 4 in the central heater cap 2, thus more hotter molecules will be automatically diverted to said member due to the theory of displacement, which is a most desirable object of the invention. The emitter cap 3 on the end of each member could be a long base panel for radiant heating or a cap with fins thereon and a fan placed behind thereof to circulate such air and a thermostat could control said fan; furthermore if radiant or panel heating is used in each room then no thermostat is needed since the heat transfer member to each room will automatically cease to operate whenever that particular room's temperature attains the temperature of the heater cap 2, which could be heated to just 72 degrees or as desired.

When the heat transfer device in FIG. 1 is used to replace a circulating hot water system such as presently used in automobiles then only the emitter cap 3 is not needed because the present heater core with its fan mounted under and behind the dashboard of all automobiles will be made the emitter cap 3. The heater cap 2 will be attached to the manifold of the engine then the tube 1 will be extended to the present connection to the hot water input of the heater core located at the firewall of said automobile. The adjacent end of tube 1 will have the wick 6 extending about an inch or two beyond the end of tube 1 and is reenfored with a wire to keep same straight, furthermore the wick 6 is held in a center position at the end of tube 1 by having a stand off in the end of said tube 1. The reenforced end of wick 6 is inserted into the hot water input of the heater core and the end of tube 1 is connected thereto to form a water tight connection. The small return feed of the heater core is plugged and the system is filled with water or antifreeze and the device is ready for use. Since the side of the heater cap 2 is attached to the manifold of the engine said cap 2 will attain a very high temperature immediately after the engine is started because said manifold is heated by the extreemly hot exhaust gases the instant that the engine is started. Such heat is quickly transferred through the heater cap 2, blanket 4 and tube 1 into the heater core as previously described, thereby when the heater switch is turned on in the automobile then the baffle will open and fan will blow such heated air into the passenger compartment heating same to a comfortable temperature in just a few seconds even when the temperature is at or below zero degrees centigrade.

Figure 3:
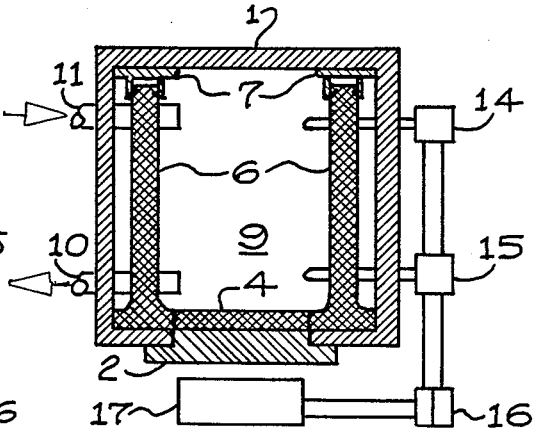
FIG. 3 is a cross sectional view of the invention as used in a hot water heating and storage system, whereby a blanket and a plurality of rope type wicks are used therein.

FIG. 3 is a hot water heating and storage system using the invention, whereby the main embodiment of said invention is the use of a blanket 4 and a wick 6 therein; however in this application the emitter cap is not needed. The water storage tank 1 may be a small tank made of any type of nonconductive material, such as high impact plastic and have an outer insulation thereon, since the requirements of the tank are very low because the weight of the water therein will be very low and the water pressure will be normal; furthermore the temperature of the water therein will always be well below the boiling point of water, hence increased pressure from steam will not be a problem, such safety factors will be apparent as this invention is explained. All or any portion of the bottom of said tank 1 will be made of a high heat conductive metal heater plate 2, whereas to the inner side thereof is attached a fibrous and highly absorbent blanket 4. One or more rope like wicks 6, made of the same material as the blanket 4, are attached to the outer portions of blanket 4 and the other adjacent ends thereof are extended upward to and are fastened to sleeve plugs 7 in the top of said tank 1. A very important object of the invention is that the heating cycle is completed at a very rapid pace; therefor the heat source intensity only needs to be adjusted to heat water at the blanket 4 to just a degree or two above the thermostat setting, thereby even with a thermostat failure the water would never reach the bowling point under continuous heating. Furthermore when all the molecules of water in said tank 1 are of the same temperature as the heater plate 2 then the molecular flow of molecules cease and such water will not take on any more heat. Consequently a two-stage switch 16 is connected to heat source 17 and to thermostat 15 by sensor connector 14 so that both controls are operated by one switch 16. The dial on switch 16 would be calibrated in degrees with a stop at 180 degrees, whereby this is the maximum water temperature at any time. When said dial of switch 16 is set to a specific temperature then stage one to thermostat 15 will control the intensity of the heat source and the second stage would set the thermostat to indicated temperature, whereby the heat sensor 14 will turn the heat off or on according to the temperature of the water therein to conserve energy. FIG. 3 the dial setting of switch 16 is turned from off to the temperature degrees desired, then the heat source 17 will heat the colder molecules separated and suspended in blanket 4 and eject said heated molecules into chamber 9 forming layers of hotter molecules adjacent to and above blanket 4 and such layers will quickly build up from said blanket 4 to the top of said tank 1. The forceful ejection of the hotter molecules from the blanket 4 will produce a cumulative force that will push the colder molecules ahead thereof into the upper portion of tank 1 and into and down the wicks 6 into blanket 4 to satisfy the theory of displacement in an orderly and efficient process. The plurality and diameter of wick 6 is determined by providing the flow area and volume of colder molecules to move in so that the rate thereof will exceed or be equal to the rate that hotter molecules are ejected from said blanket 4. Furthermore the hot water outlet 10 is located near the bottom, adjacent to and above blanket 4, of tank 1, thus during constant withdrawal of hot water said outlet 10 is at the point of hot water creation and will supply the demand eliminating hot water depletion. The cold water inlet is located near the top of tank 1 indicated by numerial 11 which is most advantageous for flow through wicks 6.

Figure 4:
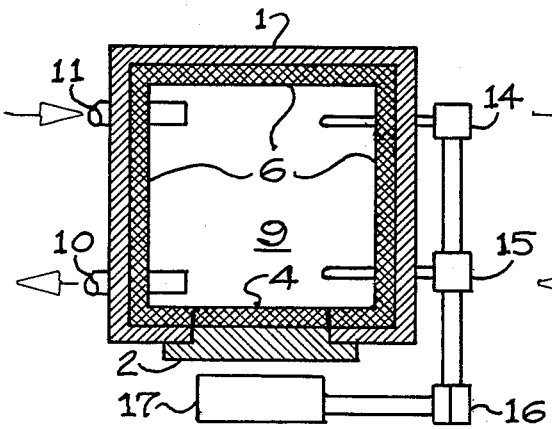
FIG. 4 is a cross sectional view of the invention as used in a hot water heating system similar to FIG. 3; however in this drawing the entire inner chamber is lined, whereby said lining adjacent to and above the heat source will automatically become the blanket while the balance of the inner lining will automatically become a self insulating wick.

FIG. 4 is similar to FIG. 3 whereby both embrace the embodiment of the invention; however the only difference is the shape and form of wick 6. In FIG. 4 all the inner surfaces of chamber 9 is covered with one continuous lining of a fibrous and absorbent capability material, whereby only that portion of said lining that covers the inner surface of heater plate 2, which is positioned directly above heat source 17 becomes the blanket 4 and will operate as previously described. The remainder of said lining on the inner surfaces of chamber 9 is and will operate and one continuous wick 6.

The heat source 17 will heat the heater plate 2 then by conduction and molecules of water separated and suspended in blanket 4 will be heated at a very rapid rate and eject said hotter molecule into chamber 9 adjacent to and above blanket 4 and move upward in mass, thus pushing the colder molecules ahead of same, whereby colder molecules will go into wick 6 at any point along the lined side walls or at the top of said chamber 9 then down into blanket 4 complete the heating cycle. Said wick 6 lining all the walls and the top of chamber 9 not only provides the path of least resistance exclusively for colder molecules to travel but said wick 6 also provides and excellent insulation for retaining the hot water therein at the set temperature for a long period of time. The effectiveness of said insulation 6 with colder molecules therein can be attested to by understanding the Gulf Stream effect, whereas hot water travels thousands of miles through cold Atlantic waters, with very little heat loss in route, to disperse its heat on the European coast and said invention in FIG. 4 will operate in the same manner.

Figure 5:
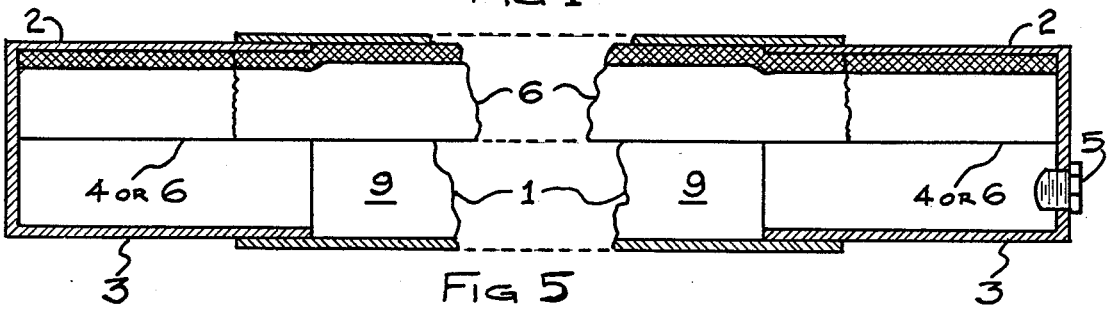
FIG. 5 is a cross sectional view of the invention used as a bidirectional system for temperature control.

FIG. 5 is a temperature control device that is the same as the device in FIG. 1; however the device in FIG. 5 is a bidirectional device with just a slight variation to the form of the blanket and wick while conforming to the basic embodiment of the inventin. In FIG. 5 a tube 1 with a metal cap connected to each end thereof forms an enclosed chamber 9. A one continuous lining forming a blanket 4 and a wick 6 will cover a segment of the inner surface of the complete chamber 9 also including the said caps; however in FIG. 5 one half of the inner surface of tube 1 is lined forming a wick 6 and each of the caps have one half of the surfaces therein lined, which will automatically become either a blanket 4 or an extention of wick 6 as the environment dictates, while said device operates the same as explained for FIG. 1. It will become apparent that the cap located in an environment with a higher temperature, said cap will automatically become a heater cap 2 and use the partial blanket 4 therein to transfer heat through tube 1 to the cap on the other adjacent end thereof, which will automatically become an emitter cap and disperse such heat through the unlined segment of said cap which is now an emitter cap 3. Furthermore the lined segment in emitter cap 3 now becomes an extention of wick 6 and will function as such.

As an example, if one end of tube 1 with the cap thereon is placed in an underground stream that has a constant temperature of 72 degrees and the other cap on the other adjacent end of tube 1 is extended to an enclosure the temperature therein said enclosure would be kept at 72 degrees even if the outside temperature was variable. Such automatic temperature control is based on the operation principle that the cap in the environment of a higher temperature will automatically become a heater cap and will transfer such excess heat to the other cap whereever it may be; therefore in said example the cap in said enclosure will disperse heat therein or pull heat therefrom or be neutral when both caps are at the same temperature. When the temperature in the enclosure is above 72 degrees then the cap therein will automatically become a heater cap and transfer such excess heat to the underground stream to be dispersed therein; further more when the temperature in said enclosure is below 72 degrees then the cap therein will atuomatically become and emitter cap 3 and the cap in the underground stream would become a heater cap 2 and transfer such heat to the enclosure to bring its temperature up to 72 degrees.

The disclosure of the invention described hereinabove represents the preferred embodiment of the invention; however, variations thereof in the form, construction and arrangement of the blanket, wick and the tubes with caps thereof and the modified applications of the invention are possible without departing from the spirit and scope of the appended claims.

I claim:

1. A heat transfer assembly comprising:

(A) a tubular member comprising walls having low heat conductivity therethrough, (B) heater cap means sealed to one end of said tubular member, said heater cap means comprising walls having high heat conductivity therethrough, (C) heat emitter cap means sealed to another end of said tubular means, said emitter cap means comprising walls having high heat conductivity therethrough, (D) fibrous blanket means lining said heater cap means, (E) fibrous wick means extending continuously through said heater cap means and said tubular means, and (F) heat transfer liquid completely filling said assembly and saturating said blanket and said wick means.

2. The heat transfer assembly of claim 1 wherein said blanket means comprises a plurality of layers of fine mesh.

3. The heat transfer means of claim 1 wherein said fibrous wick means in columnar in shape and is spaced from the walls of said tubular member.

4. The heat transfer means of claim 1 wherein said fibrous means comprises an extension of said blanket means along a wall of said tubular member.

5. The heat transfer means of claim 4 wherein said fibrous means extends into said emitter cap, substantial areas of said emitter cap and said heater cap being free from blanket means, whereby said assembly can transfer heat toward either end.

* * * * *